US008083556B2

(12) United States Patent
Stadler et al.

(10) Patent No.: US 8,083,556 B2
(45) Date of Patent: Dec. 27, 2011

(54) SINGLE TERMINAL

(75) Inventors: Hermann Stadler, Donaueschingen (DE); Frank Walter, Blumberg (DE)

(73) Assignee: MC Technology GmbH, Blumberg (DE)

( * ) Notice: Subject to any disclaimer, the term of this patent is extended or adjusted under 35 U.S.C. 154(b) by 251 days.

(21) Appl. No.: 12/453,910

(22) Filed: May 27, 2009

(65) Prior Publication Data

US 2009/0305581 A1 Dec. 10, 2009

(30) Foreign Application Priority Data

Jun. 5, 2008 (DE) ..... 10 2008 026 805

(51) Int. Cl.
*H01R 4/48* (2006.01)

(52) U.S. Cl. ..... 439/834

(58) Field of Classification Search ..... 439/834, 439/436–441, 81, 835, 266, 268, 709, 267, 439/736

See application file for complete search history.

(56) References Cited

U.S. PATENT DOCUMENTS

| | | | | |
|---|---|---|---|---|
| 6,254,422 | B1 | 7/2001 | Feye-Hohmann | |
| 7,004,781 | B2 * | 2/2006 | Walter | 439/441 |
| 7,695,327 | B2 * | 4/2010 | Bauerle et al. | 439/811 |
| 2003/0194918 | A1 | 10/2003 | Fricke et al. | |

FOREIGN PATENT DOCUMENTS

| | | | |
|---|---|---|---|
| DE | 1 829 453 | U | 4/1961 |
| DE | 6801424 | U | 2/1969 |
| DE | 75 24 236 | U | 12/1975 |
| DE | 81 09 133 | U1 | 8/1981 |
| DE | 295 16 450 | U1 | 1/1996 |
| DE | 20 2004 007 077 | U1 | 8/2005 |
| DE | 10 2005 014 075 | B3 | 10/2006 |
| DE | 20 2007 002 061 | U1 | 7/2007 |
| DE | 10 2007 004 545 | A1 | 7/2008 |
| DE | 10 2007 004 547 | A1 | 7/2008 |
| WO | WO 02/073746 | A1 | 9/2002 |

* cited by examiner

*Primary Examiner* — Edwin A. Leon
(74) *Attorney, Agent, or Firm* — The Nath Law Group; Jerald L. Meyer; Stanley N. Protigal

(57) ABSTRACT

The disclosed technology relates to a single terminal (10, 110) with a terminal body (20, 120) designed in the shape of a frame and made of an electrically conductive material, with at least one connection pin (27, 127) being arranged on one exterior side (20, 120) and a clamping spring (30, 130) being inserted in the terminal body (20, 120).

14 Claims, 9 Drawing Sheets

SINGLE TERMINAL

The present disclosure relates to a single terminal.

Single terminals have been known with a terminal body designed as a frame or circularly enclosed and made of an electrically conductive material, with at least one extension pin executed as one piece attached to the exterior side of the terminal body. Such single terminals are disclosed for example in the not yet published patent applications DE 10 2007 004 587 or DE 10 2007 004 545. The single terminals described there have in one side of the terminal body a passage borehole with an interior thread through which a terminal screw can be screwed in in order to hold in position an electric conductor guided into the interior of the terminal body and to achieve an electrically conductive connection between the electric conductor and a circuit board connected via the extension pin in electrically conductive fashion. However, the terminal screw makes the connection of the electric conductor in the single terminal relatively difficult for the user. Therefore, it is the objective of the invention to provide a single terminal that has a simple structure and is user friendly.

This disclosure is directed to a single terminal with a terminal body designed in the shape of a frame and made of an electrically conductive material at least one connection pin being arranged on one exterior side and a clamping spring being inserted in the terminal body.

Advantageous embodiments and further developments include various configurations in which a terminal body designed as one piece, a terminal body made of brass, a terminal body produced through a machining process, in particular through machining processes on a block of material, a terminal body which has a wall thickness of more than 0.5 mm, in particular of more than 1 mm, the clamping spring is designed as a leaf spring or a cage extension spring, the clamping spring fitted with a support arm and a clamping arm, with the clamping spring abutting the terminal body with its support arm, the clamping spring made of an electrically conductive material, the clamping spring made of a material with good resilience properties, the clamping spring is calked, compressed, welded, riveted or soldered in the terminal body, the terminal body has at least one element that fixes the inserted clamping spring into place after crimping or deforming, the clamping spring has a structure with which it engages with a correspondingly shaped structure of the terminal body in form-fitting fashion, and the structure is arranged in the support arm of the clamping spring.

The single terminal has a terminal body that is constructed in the shape of a frame and that is made of an electrically conductive material, with at least one connection pin, particularly one executed as one piece, being attached to one exterior side of the terminal body and with a clamping spring being inserted in the terminal body. The clamping spring is arranged in such a way that a electric conductor that is to be connected can be moved into the terminal body against the spring action of the clamping spring and held in place by clamping action between the clamping spring and the terminal body. At the same time, the clamping spring secures the electrically conductive contact between the electrical conductor and the terminal body. The connection of an electric conductor in such a single terminal can be carried out considerably more swiftly since the electrical conductor merely needs to be pushed against the spring action and does not need to be screwed in with greater effort.

Particularly preferably, the terminal body is made in one piece and is manufactured particularly preferably through a machining process, in particular through machining processes on a massive block of material. This method makes a simple and cost-effective manufacture of the terminal body possible.

Preferably, the terminal body is made of brass since this material is inexpensive and still has good electrically conductive properties.

Preferably, the terminal body has a wall thickness of more than 0.5 mm, in particular of more than 1 mm. The terminal body is thus stable enough to simultaneously form the casing of the single terminal so that no additional casings, in particular insulating casings, are necessary around the terminal body and the single terminal is therefore constructed particularly easily and cost-effectively.

In one configuration, the clamping spring is designed as a cage extension spring since such springs are easy and cost-effective to manufacture and can be easily arranged in the terminal body. Moreover, such springs offer a secure anchoring option for an electric conductor to be connected.

Preferably, the clamping spring has a support arm and a clamping arm, with the clamping spring abutting the terminal body with its support arm. A large-area abutting surface is thereby made possible between the clamping spring and the terminal body.

Particularly preferably, the clamp spring is made of an electrically conductive material in order to assure an electrically conductive contact between the electric conductor to be connected and the terminal body not only when the electrical conductor touches an interior surface of the terminal body but also via the clamping spring.

Preferably, the clamping spring is made of a material with good elastic properties so as to assure a reliable clamping of the connected electrical conductor at any time.

Preferably, the clamping spring is calked, welded, riveted or soldered into place in order to prevent the clamping spring from dislocating or even detaching from the terminal body. Preferably, at least one element is attached to the terminal body inside of the terminal body to fix the clamping spring in place, thereby fixing the inserted clamping spring in place following a bending over or deformation. In another preferred embodiment, the clamping spring has a structure with which it engages in a correspondingly formed structure of the terminal body in form fitting fashion in order to prevent a detachment or dislocation of the clamping spring in the terminal body. This structure is preferably in the support arm of the clamping spring since the latter has already a large-area contact surface with regard to the terminal body.

BRIEF DESCRIPTION OF THE DRAWINGS

The disclosed technology is explained in detail by means of the following figures. Shown are in.

DETAILED DESCRIPTION

Figure 1B:
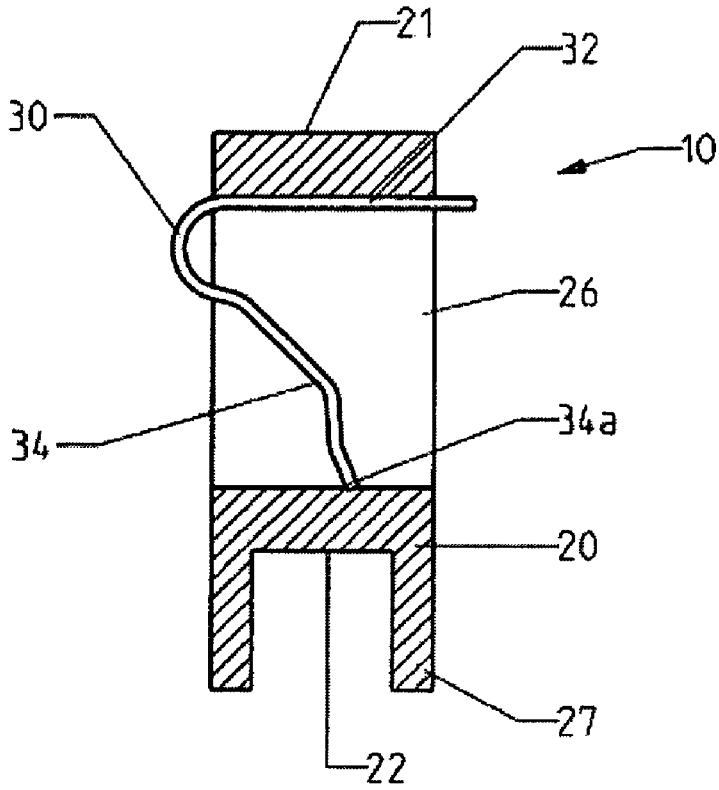
FIG. 1*a* a perspective view of a first embodiment example of a single terminal, FIG. 1*b* a longitudinal cut through the single terminal in accordance with FIG. 1*a*, FIG. 2*a* a perspective view of a second embodiment example of a single terminal FIG. 2*b* a perspective view of the single terminal in accordance with FIG. 2*a* with bent over ridges, FIG. 3 a perspective view of a third embodiment example of a single terminal, FIG. 4 a perspective view of a fourth embodiment example of a single terminal, FIG. 5 a perspective view of a fifth embodiment example of a single terminal, FIG. 6 a perspective view of a sixth embodiment example of a single terminal, FIG. 7*a* a perspective view of a clamp body of a seventh embodiment example of a single terminal, FIG. 7*b* the terminal body in accordance with FIG. 7*a* with bent over ridges, FIG. 7*c* the terminal body in accordance with FIG. 7*a* with inserted clamping spring, FIG. 8*a* a perspective view of an eighth embodiment example of a single terminal, FIG. 8*b* a longitudinal cut through the single terminal in accordance with FIG. 8*a*, FIG. 9*a* a perspective view of an ninth embodiment example of a single terminal, and FIG. 9*b* a longitudinal cut through the single terminal in accordance with FIG. 9*a*.
Figure 1A:
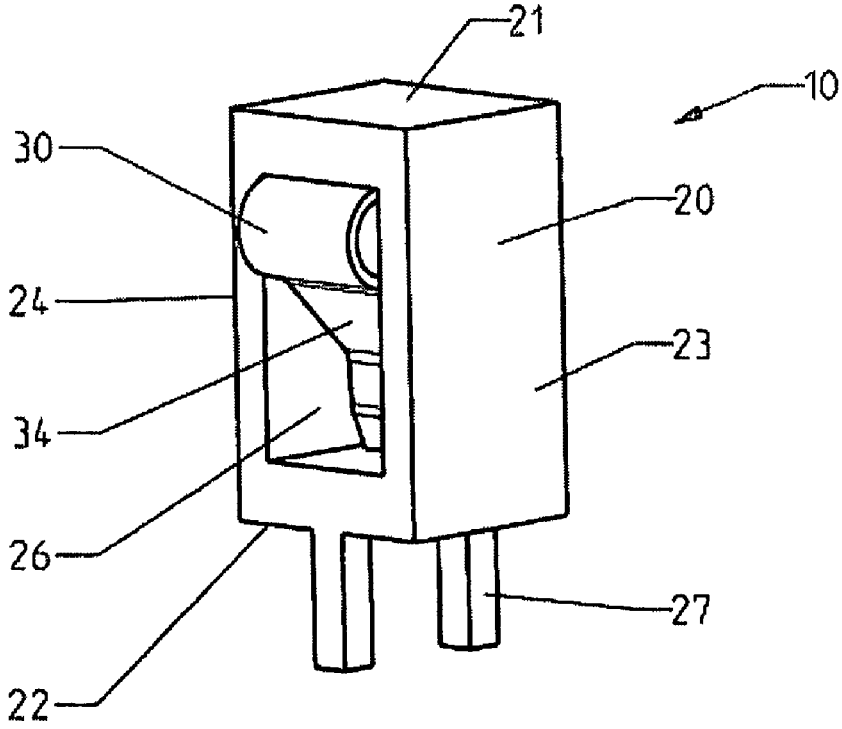

FIGS. 1*a* and 1*b* show a first embodiment example of a single terminal 10 with a terminal body 20 and a clamping spring 30. The terminal body is designed in the shape of a frame. This means that the terminal body is designed as circumferentially closed. The terminal body has an upper side 21, a bottom side 22 arranged parallel thereto, and two lateral surfaces 23, 24 running vertically thereto and connecting the upper side 21 and the bottom side 22, the lateral surfaces enclosing an interior space 26, with the interior space 26 thereby forming a passage way through the terminal body 20. Two connecting pins 27 are arranged on the surface of the bottom 22 side that is turned outward.

The terminal body is executed as one piece and can be made, for example, through machining processes to a massive material block. The terminal body 20 is made of an electrically conductive material, for example of brass. The upper side 21, the bottom side 22 as well as the two lateral surfaces 23, 24 each have a wall thickness of at least 0.5 mm, preferably of more than 1 mm. The single terminal 10 has no insulating casing.

The clamping spring 30 is inserted in the interior space 26 of the terminal body 20. The clamping spring 30 is particularly designed as a leaf spring. The clamping spring 30 has a support arm 32 and a clamping arm 34, with the angle enclosed between the support arm 32 and the clamping arm 34 being smaller than 90°. As can be seen particularly in FIG. 1*b*, the support arm 32 abuts the interior surface of the upper side 32 of the terminal body 30. Due to the angle enclosed between the support arm 32 and the clamping arm 34 being less than 90°, the clamping arm 34 protrudes into the interior space 26 and crosses it, starting from the upper side in such a way that a free end of the clamping arm 34 comes to rest on the interior surface of the bottom side 22. To ensure that the clamping spring 30 is fixed in place in the terminal body 20, the two lateral sides 23, 24 are compressed against each other after the clamping spring 30 has been inserted.

In order to connect an electric conductor to the single terminal, the electric conductor—with its free end stripped of its insulation—is pushed into the interior space 26 of the terminal body 20 in such a way that the clamping arm 34 is rotated against its spring action against the support arm 32 whereby in particular the angle enclosed between the support arm 32 and the clamping arm 34 is reduced. The spring action of the clamping arm 34 presses the electric conductor against the bottom side 22 of the terminal body 20 with the effect that the electric conductor is being held between the free end of the clamping spring 30 and the bottom side 22. Thus, an electrically conductive contact can be created via the electrically conductive terminal body 20 between the electric conductor and the connecting pins 27 which, for example, are in electrically conductive contact with the conductor paths of a circuit board. The electrically conductive contact between the electrical conductor and the terminal body 20 is further improved if the clamping spring 30 is made of an electrically conductive material.

Only one single electrical conductor can be connected to the single terminal 10.

The connection of an electrical conductor to the single terminal 10 can be significantly simplified through the use of the clamping spring 30.

Figure 2A:
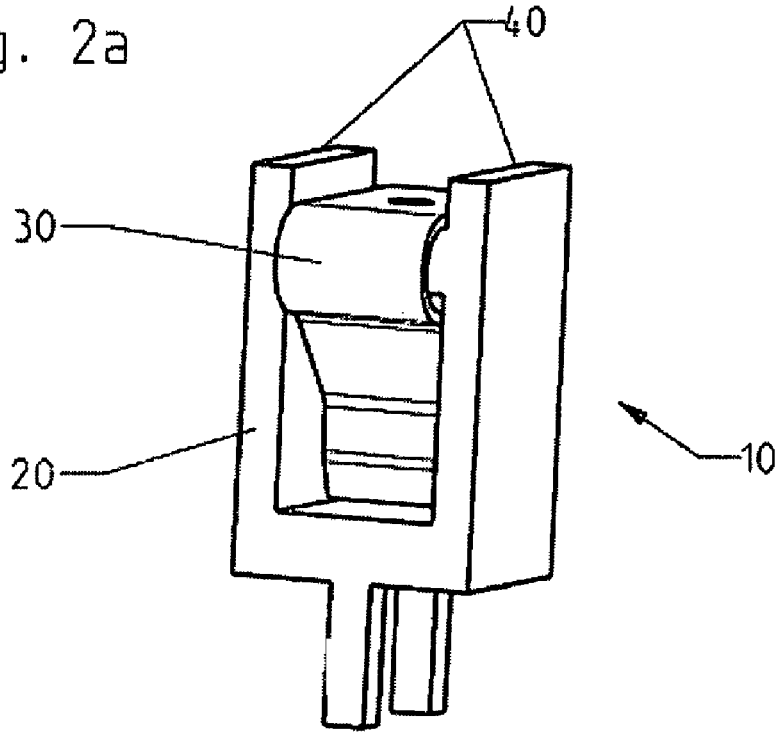
Figure 2B:
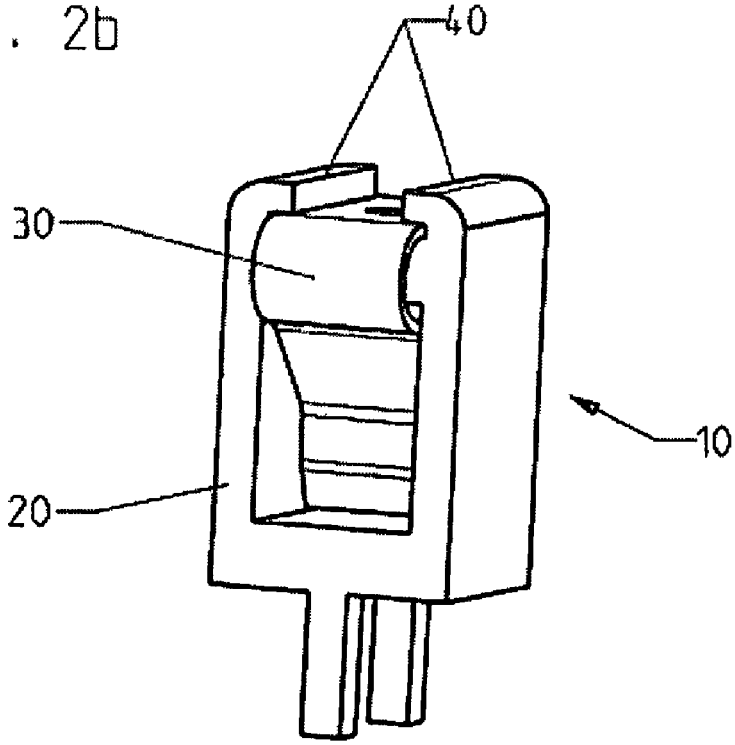

A second embodiment example of the single terminal 10 is shown in FIGS. 2*a* and 2*b*. The terminal body 20 of the second embodiment example of the single terminal 10 differs from the first embodiment example shown in FIGS. 1*a* and 1*b* in that the lateral sides 23, 24 are each extended in a ridge 40 beyond the upper side 21. The clamping spring 30 is inserted into the terminal body 20 in such a way that the support arm 32, with its interior surface turned towards the clamping arm 34, rests on the exterior surface of the upper side 21 of the terminal body 20 and the clamping arm 34 reaches around the upper side 21 so it can protrude into the interior space 26. The upper side 21 thus forms a stop when the clamping spring 30 is pushed into the terminal body 20 and prevents the clamping spring 30 from sliding out in one direction. The clamping spring can be fixed in place in particular if the ridges 40—after the clamping spring 30 has been inserted into the terminal body as shown in FIG. 2*b*—are crimped or bent over towards the interior on the upper side 21 in order to fix the support arm 32 of the clamping spring 30 in place in this fashion. The support arm 32 is thereby clamped in place between the crimped ridges 40 and the exterior surface of the upper side 21 of the terminal body.

Figure 3:
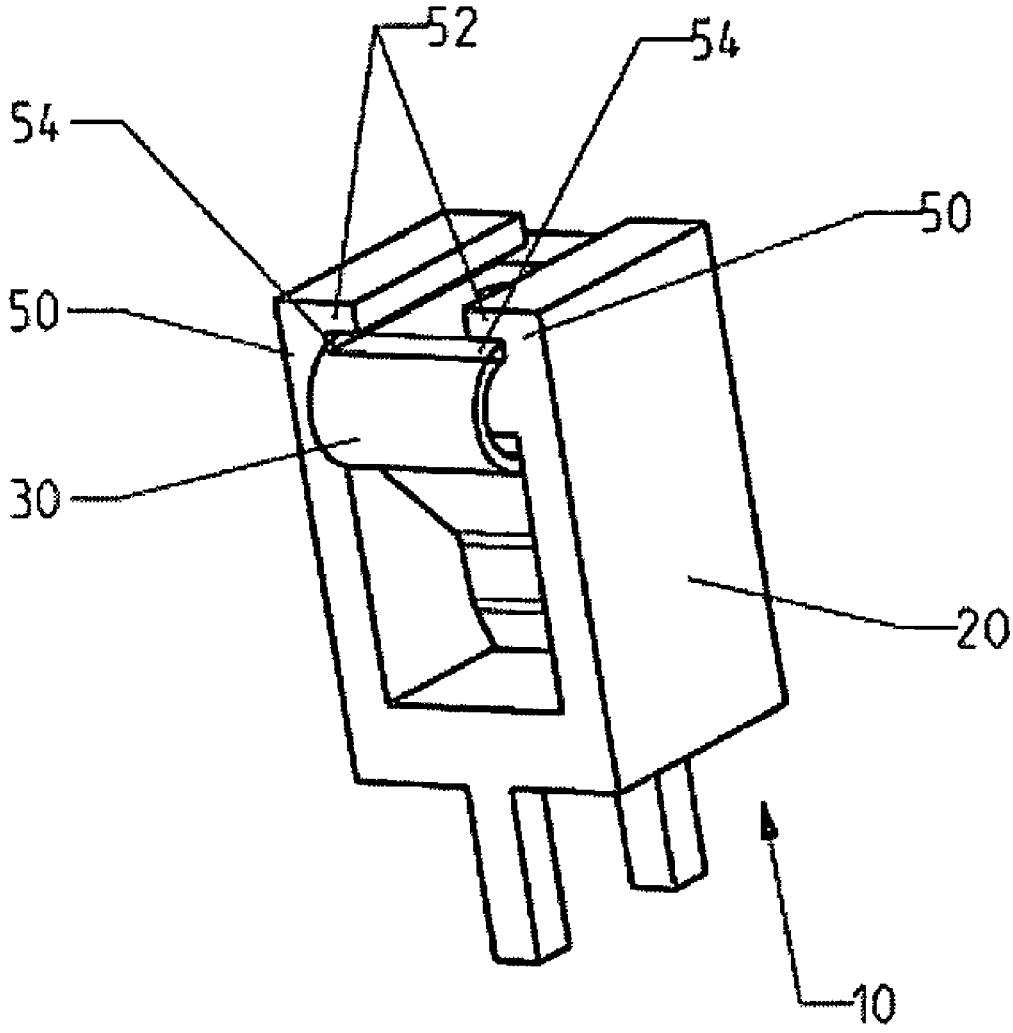

FIG. 3 shows a third example of an embodiment of the single terminal 10 whose terminal body differs from the terminal body 20 of the first example of an embodiment shown in FIGS. 1*a* and 1*b* in that the lateral surfaces 23, 24 are also extended beyond the upper side 21 in ridges 50, however with a protrusion 52 being arranged on the areas of the lateral surfaces 23, 24 facing each other to the effect that an undercut 54 is formed on each ridge 50. The two undercuts 54 form a kind of guide rail between which the support arm 32 can be inserted on the upper side 21 in such a way that the area of the support arm 32 facing the clamping arm 34 comes to rest on the exterior surface of the upper side 21 while the clamping arm 34 is guided around the upper side 21 into the interior space 26. To fix the clamping spring 30 in place, the protrusions 52 can be deformed in such a way that they are pressed onto the clamping spring 30 in order to hold the support arm 32 in place in clamping fashion between the protrusions 52 and the upper side 21 of the terminal body 20.

Figure 4:
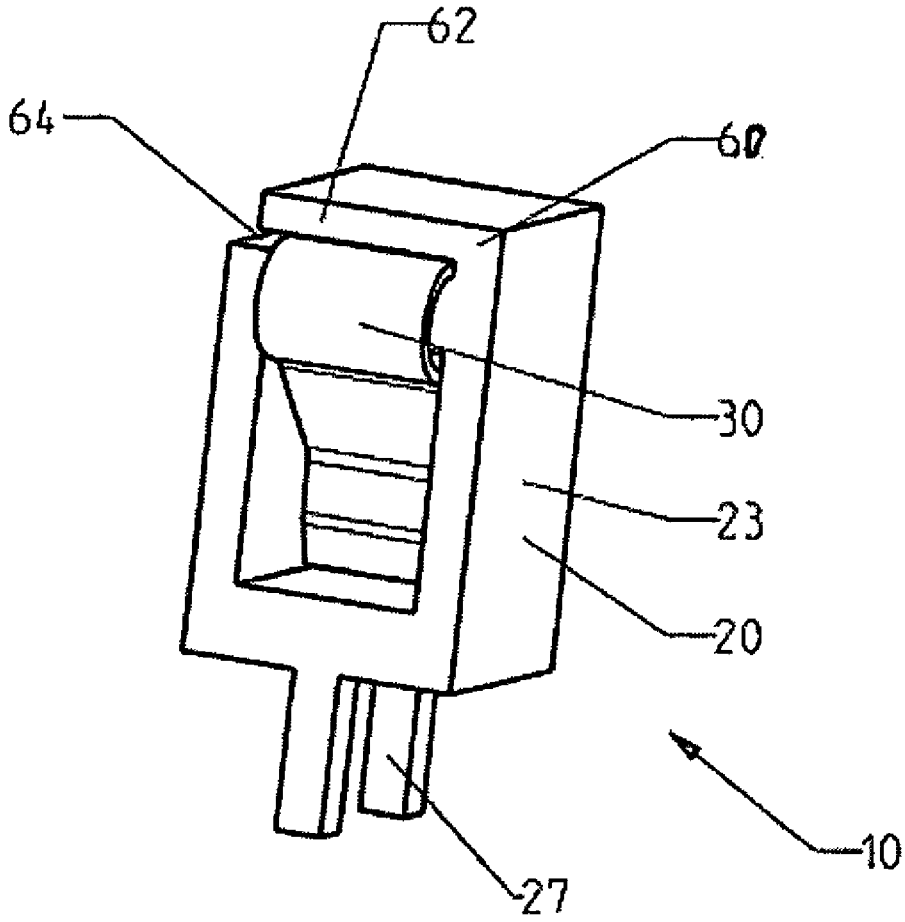

FIG. 4 shows a fourth embodiment example of the single terminal 10 which differs from the third embodiment example shown in FIG. 3 in that only one of the two lateral surfaces 23, 24, in this case the lateral surface 23, is extended beyond the upper side 21 into a ridge 60, with a protrusion being arranged on the free end of the ridge 60 essentially at a right angle which has nearly the same area as the upper side 21 so that a guiding slot 64 is formed between the protrusion 62 and the upper side of the terminal body 20 into which the support arm 32 of the clamping spring 30 can be pushed. The clamping arm 34 of the clamping spring 30 in turn reaches around the upper side 21 into the interior space 26 of the terminal body 20. For a final fixing of the clamping spring 30 on the terminal body 20, the protrusion can again be deformed or bent over so that it is pressed in the direction of the support arm 32 of the clamping spring 30, thereby fixing the support arm 32 in place in clamping fashion.

Figure 5:
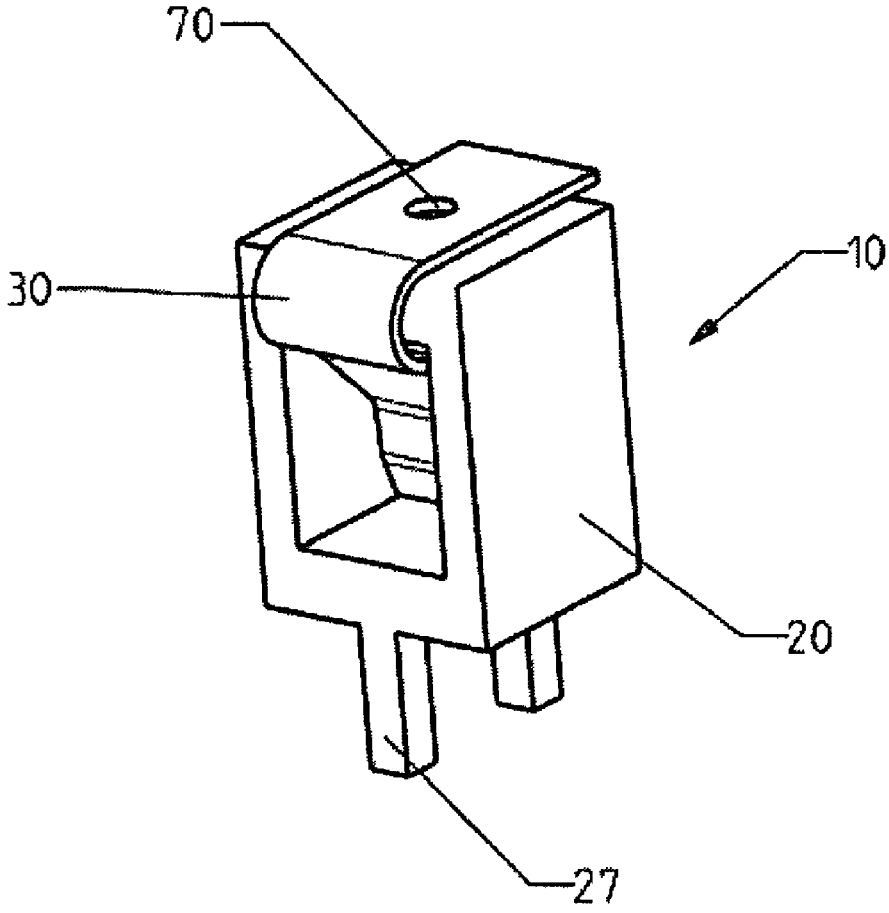

FIG. 5 shows a fifth embodiment example of the single terminal 10. Here, the clamping spring 30 is arranged on the terminal body 20 in such a way that the surface of the support arm 32 turned away from the clamping arm 32 does not abut the interior surface of the upper side 21 as shown in the first embodiment example shown in FIGS. 1*a* and 1*b* but that the surface of the support arm 32 turned towards the clamping arm of the clamping spring 30 abuts the exterior side of the surface 21. For a fixation of the clamping spring 30 on the terminal body 20, the clamping spring is fitted with a welding or soldering spot 70 in the support arm 32.

Figure 6:
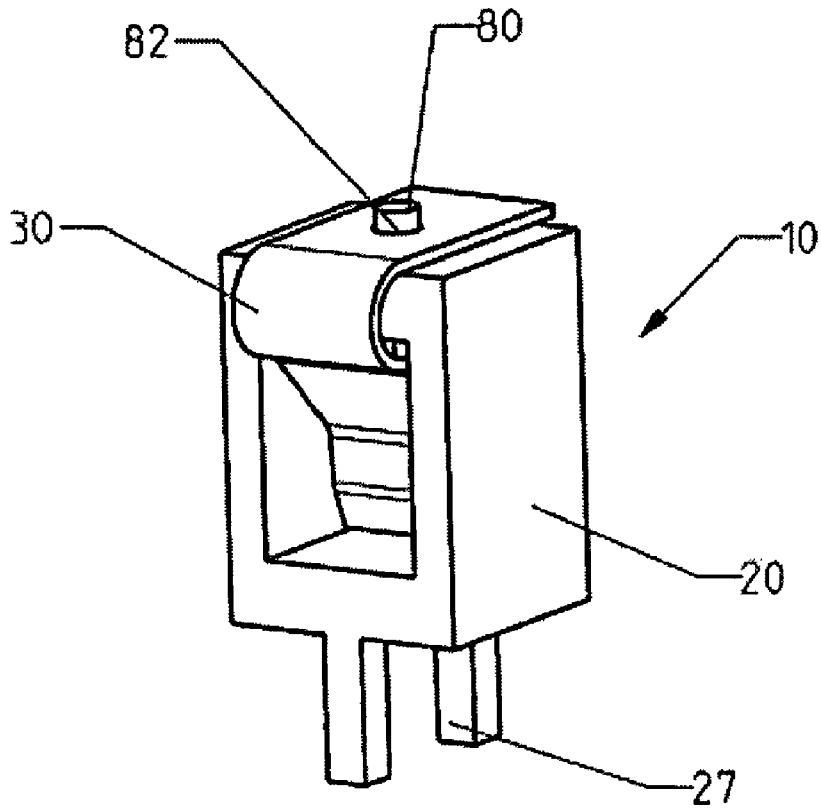

The sixth embodiment example of the single terminal 10 shown in FIG. 6 differs from the fifth embodiment example shown in FIG. 5 in that in lieu of a welding or soldering slot, the clamping spring 30 is riveted to the terminal body 20. In addition, a structure, in particular a rivet shank 80, is arranged on the exterior surface of the upper side 21 of the terminal body 20 which engages with a corresponding structure of the support arm 32, in particular a borehole 82. Upon attaching the clamping spring 30 to the rivet shank via the borehole 82, the clamping spring 30 is riveted to the terminal body 20. The corresponding structures between the terminal body 20 and the clamping spring 30 may also be different structures or locking mechanisms engaging with each other in form-fitting fashion via which the clamping spring 30 can be fixed to the terminal body 20. In particular, these structures may also be arranged on the interior surface of the upper side 21 of the terminal body 21 as well as on the surface of the support arm 21 of the clamping spring turned away from the clamping arm 34 in order to fix the clamping spring 30 on the terminal body 20.

Figure 7A:
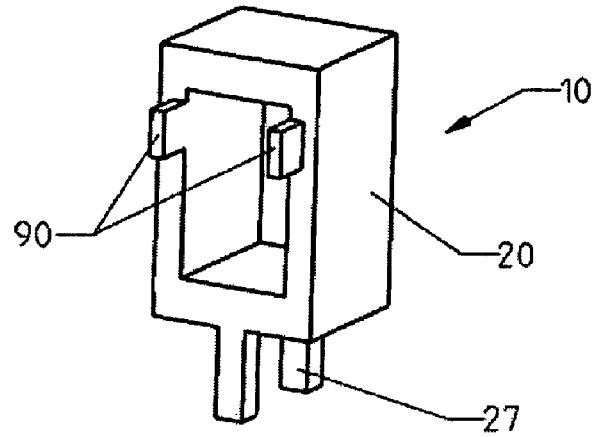
Figure 7B:
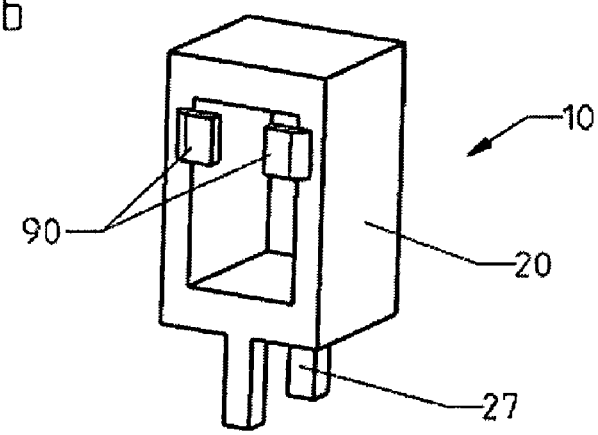
Figure 7C:
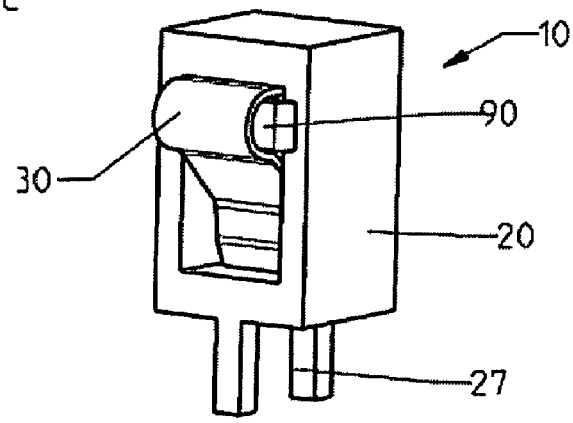

A seventh embodiment example of the single terminal 10 is shown in FIGS. 7*a*, 7*b* and 7*c* whose terminal body 20 differs from the terminal body 20 of the first embodiment example shown in FIGS. 1*a* and 1*b* in that a ridge 90 is arranged on the lateral edges of the lateral surfaces 23, 24 in a direction parallel to the lateral surfaces 23, 24 and parallel to the upper side 21 on each of the lateral surfaces 23, 24 with the ridge protruding in particular forward, i.e. along the insertion direction of an electrical conductor to be connected and which is bent over in a first circumferential or stamping process, in each case towards the other ridge, whereby during the insertion of the clamping spring 30 an insertion stop for the clamping spring 30 results when the surface of the support arm 32 turned away from the clamping arm 34 comes to rest on the upper side of the terminal side 20. The two bent-over ridges 90 are encompassed by the clamping arm 34 in such a way that subsequently the clamping arm 34 protrudes into the interior space 26 of the terminal body 20 as can be seen particularly in FIG. 7*c*. A fixation of the clamping spring 30 may be done by way of crimping the lateral surfaces 23, 24.

Figure 8B:
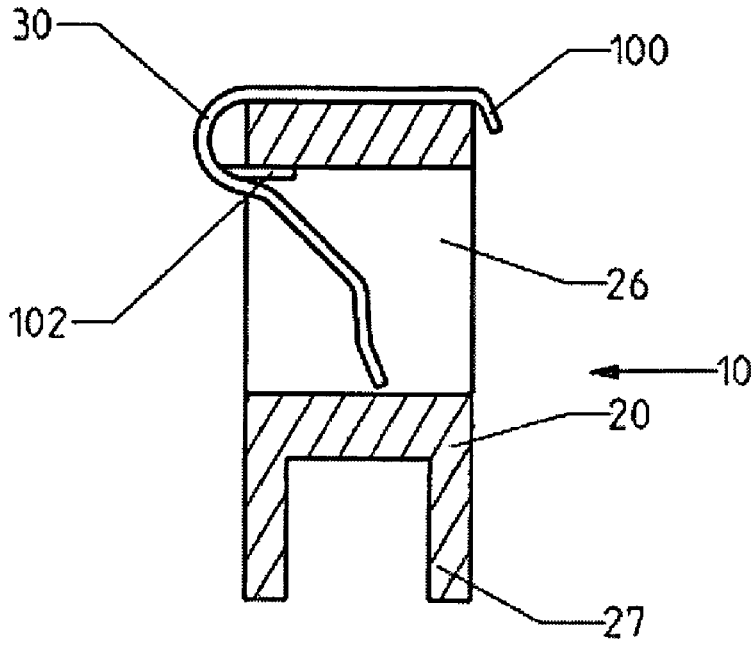
Figure 8A:
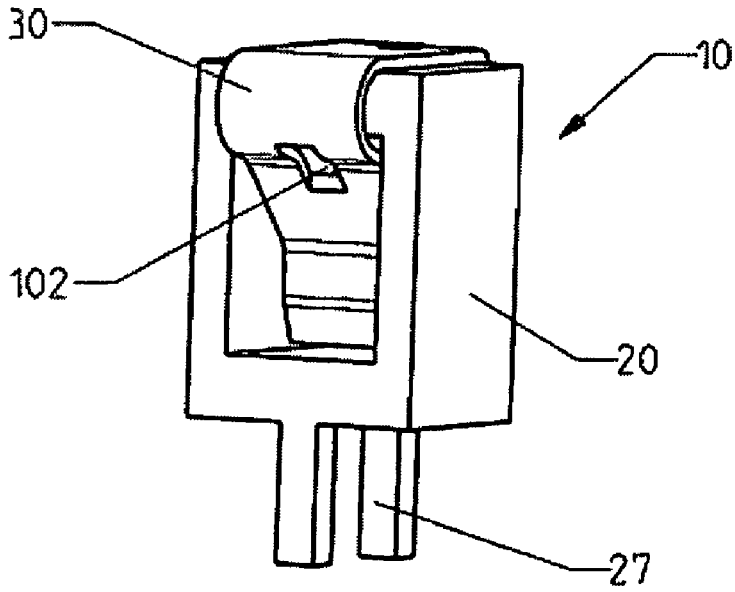

An eighth embodiment example of the single terminal 10 is shown in FIGS. 8*a* and 8*b*, with the terminal body 20 being designed identically to the terminal body 20 of the first embodiment example shown in FIGS. 1*a* and 1*b*, but with the clamping spring 30 again being arranged on the terminal body 20 in such a way that the surface of the support arm 32 facing the clamping arm 34 is arranged on the exterior surface of the upper side 21 of the terminal body 20. The clamping spring 30 is fitted with a flap 102 bent out of the clamping arm 34 that abuts the interior surface of the upper side 21 while the support arm 32 has a free end 100 bent off in the direction of the clamping arm 34 that protrudes beyond the upper side 21 so that the clamping spring 30 can be fixed on the upper side 21 in clamping fashion via the free end 100 and the flap 102.

Figure 9B:
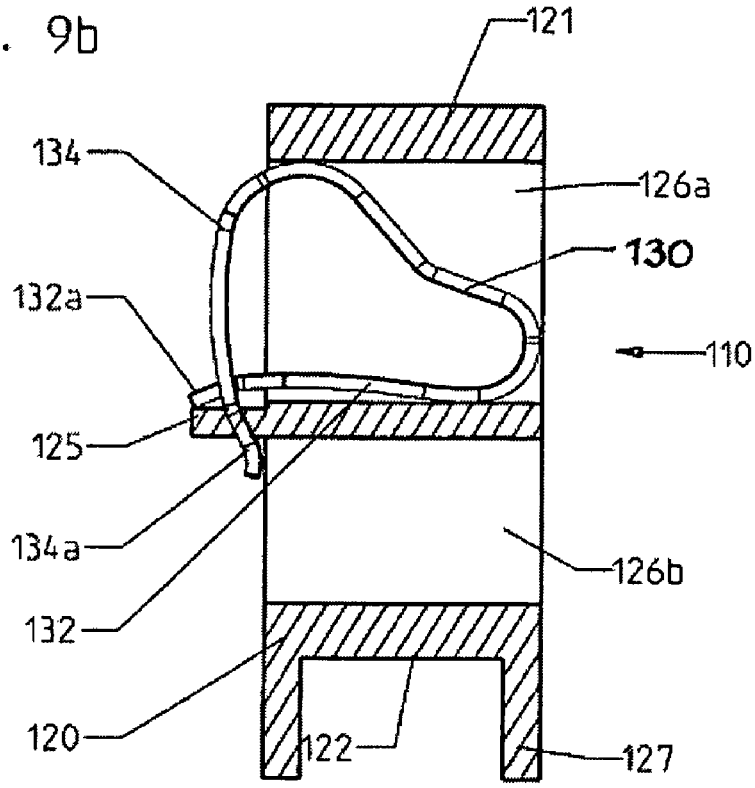
Figure 9A:
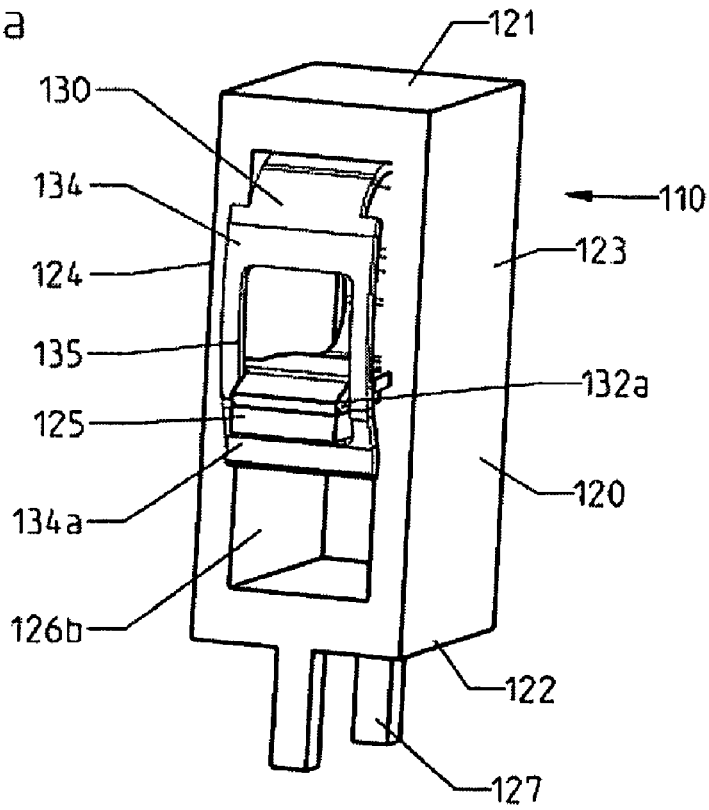

A ninth embodiment example of a single terminal 110 is shown in FIGS. 9*a* and 9*b* with a terminal body 120 and a clamping spring 130. The terminal body 120 is designed in the form of a frame, i.e. circumferentially closed. The terminal body 120 has an upper side 121, a bottom side 122 running parallel thereto, and two lateral surfaces 123, 124 running vertically thereto and connecting the upper side 121 and the bottom side 122. Two connecting pins 127 are arranged on the surface of the bottom side 212 that is turned outward. The terminal body 120 is made in one piece and may be manufactured, for example, by machining processes on a massive block of material. The terminal body 120 is made of an electrically conductive material or, respectively, of brass. The upper side 121, the bottom side 122 as well as the two lateral surfaces 123, 24 each have a wall thickness of at least 0.5 mm, preferably of more than 1 mm. The single terminal 110 has no insulating casing.

Between the upper side 121 and the bottom side 122, an intermediate bottom 125 is arranged in such a way that a first interior space 126*a* is created between the upper side 121 and the intermediate floor 125 and a second interior space 126*b* between the intermediate bottom 125 and the bottom side 122. Both intermediate spaces 126*a*, 126*b* each form a passage opening through the terminal body 120.

The clamping spring 130 which in this case is designed as a cage clamp spring is inserted in the first interior space 126*a*. The clamping spring 130 is fitted with a support arm 132 and a clamping arm 134 that are connected to each other at one end so that the support arm 132 has a free and 132*a* and the clamping arm 134 a free end 134*a*. At its free end 134*a*, the clamping arm has an aperture 135 through which the free end 132*a* of the support arm 132 protrudes.

The support arm 132 rests with its exterior surface on the surface of the intermediate bottom 125 turned to the upper side 121. The clamping arm 134 traverses the first interior space 126*a* up to the interior surface of the upper side 121 which it abuts as a rule only when no electrical conductor is connected. Starting from the interior surface of the upper side 121 of the terminal body, the clamping arm 134 runs back in the direction of the intermediate bottom 125 where its penetration is interspersed by the support arm 132. In addition to the free end 132*a* of the support arm 132, the intermediate bottom 125 which protrudes forward beyond the upper side 121 and the bottom side 122 also intersperses the penetration 125 of the free end 134*a* of the clamping arm 134.

The clamping spring 30 can be attached in the terminal body 20 for example by crimping the lateral surfaces 123, 24 or through any other of the aforementioned fixing mechanisms.

To connect an electrically conductor, the clamping arm 134 is pressed onto the bottom side 122 in such a way that the penetration 135 lies before the second interior space 126*b* and the electric conductor can be introduced through the penetration 135 into the second interior space 126*b* of the terminal body. If the spring is relaxed, the clamping arm 134 will pull the electric conductor across the penetration 135 against the surface of the intermediate bottom 125 turned to the bottom side 122 so that an electrically conductive contact is created between the electric conductor and the terminal body 120. Only one single electric conductor can be connected to the single terminal 110.

The various types of clamp springs and fixing mechanisms of the clamping springs as well as the various embodiments of the terminal bodies can of course be combined with each other in any desired fashion.

LIST OF REFERENCE SIGNS

10 single terminal
20 terminal body
21 upper side
22 bottom side
23 lateral surface
24 lateral surface
26 interior space
27 connection pin
30 clamping spring
32 support arm
34 clamp arm
34*a* free end
40 ridge
50 ridge
52 protrusion
54 undercut
60 ridge
62 protrusion
64 guiding slot
70 welding spot or soldering spot
80 rivet shank
82 borehole
90 ridge
100 free end
102 flap
110 single terminal
120 terminal body
121 upper side
122 bottom side
123 lateral surface
124 lateral surface
125 intermediate bottom
126*a* first interior space
126*b* second interior space
127 connection pin
130 clamping spring
132 support arm
132*a* free end
134 clamping arm
134*a* free end
135 aperture The invention claimed:

1. Single terminal with a terminal body designed in the shape of a frame with an upper side, a bottom side arranged parallel thereto and two lateral sides arranged orthogonal thereto, said terminal being made of an electrically conductive material said terminal comprising at least one connection pin being arranged on one exterior side and a clamping spring with a support arm and a terminal arm, said clamping spring being inserted in the terminal body, wherein at least one of the lateral sides of said terminal body is extended in a ridge beyond the upper side, wherein said ridge is clamping the support arm in place between the crimped ridge and an exterior surface of the upper side of the terminal body.

2. Single terminal in accordance with claim 1, characterized by the fact that the terminal body is designed as one piece.

3. Single terminal in accordance with claim 1, characterized by the fact that the terminal body is made of brass.

4. Single terminal in accordance with claim 1, characterized by the fact that the terminal body is produced through a machining process.

5. Single terminal in accordance with claim 1, characterized by the fact that the terminal body has a wall thickness of more than 0.5 mm, in particular of more than 1 mm.

6. Single terminal in accordance with claim 1, characterized by the fact that the clamping spring is designed as a leaf spring or a cage extension spring.

7. Single terminal in accordance with claim 1, characterized by the fact that the clamping spring is fitted with a support arm and a clamping arm, with the clamping spring abutting the terminal body with its support arm.

8. Single terminal in accordance with claim 1, characterized by the fact that the clamping spring is made of an electrically conductive material.

9. Single terminal in accordance with claim 1, characterized by the fact that the clamping spring is made of a material with good resilience properties.

10. Single terminal in accordance with claim 1, characterized by the fact that the clamping spring is calked, compressed, welded, riveted or soldered in the terminal body.

11. Single terminal in accordance with claim 1, characterized by the fact that the terminal body has at least one element that fixes the inserted clamping spring into place after crimping or deforming.

12. Single terminal in accordance with claim 1, characterized by the fact that the clamping spring has a structure with which it engages with a correspondingly shaped structure of the terminal body in form-fitting fashion.

13. Single terminal in accordance with claim 12, characterized by the fact that the structure is arranged in the support arm of the clamping spring.

14. Single terminal in accordance with claim 1, characterized by the fact that the terminal body is produced through a machining process on a block of material.

* * * * *